US007686289B2

(12) United States Patent
Ono et al.

(10) Patent No.: US 7,686,289 B2
(45) Date of Patent: Mar. 30, 2010

(54) VERTICAL COLLATING MACHINE

(75) Inventors: Hiroyuki Ono, Takashima (JP); Yoshinari Kuwabara, Kyoto (JP)

(73) Assignee: Horizon International, Inc, Shiga (JP)

( * ) Notice: Subject to any disclaimer, the term of this patent is extended or adjusted under 35 U.S.C. 154(b) by 747 days.

(21) Appl. No.: 11/101,312

(22) Filed: Apr. 7, 2005

(65) Prior Publication Data

US 2005/0242484 A1 Nov. 3, 2005

(30) Foreign Application Priority Data

Apr. 9, 2004 (JP) ..... 2004-115034

(51) Int. Cl.
*B65H 3/44* (2006.01)
*B65H 33/04* (2006.01)
*G06K 9/00* (2006.01)

(52) U.S. Cl. ..... 271/9.11; 271/9.01; 382/112; 270/58.01

(58) Field of Classification Search ..... 271/9.11, 271/9.01, 9.02, 9.05, 9.13, 9.12, 5; 399/16, 399/388; 209/576–578, 579; 382/112; 358/1–1.8, 358/1.14

See application file for complete search history.

(56) References Cited

U.S. PATENT DOCUMENTS 4,471,954 A * 9/1984 Bourg ..... 270/58.03
4,625,954 A * 12/1986 Pusey ..... 271/9.02
4,675,730 A * 6/1987 Adomaitis et al. ..... 348/131
4,724,481 A * 2/1988 Nishioka ..... 348/133
5,351,834 A * 10/1994 Duss ..... 209/576
5,503,380 A * 4/1996 Hidding ..... 270/58.02
5,956,414 A * 9/1999 Grueninger ..... 382/112
6,290,225 B1 * 9/2001 Linder et al. ..... 271/155
6,371,476 B2 * 4/2002 Isogai et al. ..... 271/3.14
6,464,449 B1 * 10/2002 Takeno ..... 414/791.2
2002/0195765 A1 12/2002 Tunink et al.
2003/0156851 A1 * 8/2003 Koh et al. ..... 399/45

(Continued)

FOREIGN PATENT DOCUMENTS

EP 0 968 948 A2 1/2000

(Continued)

*Primary Examiner*—Patrick H Mackey
*Assistant Examiner*—Patrick Cicchino
(74) *Attorney, Agent, or Firm*—Kirschstein, et al.

(57) ABSTRACT

There are provided a plurality of sheet feeding units 2*a* to 2*d* arranged in a vertical direction at spacing therebetween, a vertical sheet conveyance path G arranged oppositely with the sheet outlets 12*a* to 12*d* of the sheet feeding units 2*a* to 2*d*, conveyance means 1 and 6 for sequentially conveying the sheets fed from respective sheet feeding units 2*a* to 2*d*, vertically downward along the sheet conveyance path G, and control means controlling the sheet feeding units 2*a* to 2*d* and the conveyance means 1 and 6 in such a manner that the sheets fed from the sheet feeding units 2*a* to 2*d* are conveyed while at least partially overlapping the sheets which are fed from a sheet feeding unit of a next lower site on the sheets which are fed from the sheet feeding unit of an upper site. Imaging means 3*a* to 3*d* are arranged oppositely with the sheets conveyed on the sheet conveyance path G, and the control means controls the motions of the imaging means 3*a* to 3*d* and detects collation errors based on image data captured from the imaging means 3*a* to 3*d*.

6 Claims, 7 Drawing Sheets

U.S. PATENT DOCUMENTS

| | | | | |
|---|---|---|---|---|
| 2004/0226467 | A1* | 11/2004 | Underwood et al. | 101/484 |
| 2004/0251176 | A1* | 12/2004 | Alonso et al. | 209/576 |
| 2005/0201765 | A1* | 9/2005 | Shinga | 399/16 |
| 2006/0239699 | A1* | 10/2006 | Heimbach et al. | 399/16 |
| 2008/0037901 | A1* | 2/2008 | Yonezawa et al. | 382/291 |

FOREIGN PATENT DOCUMENTS

| | | | |
|---|---|---|---|
| JP | 11-053552 | | 2/1999 |
| JP | 11048636 | | 2/1999 |
| JP | 11053552 | * | 2/1999 |
| JP | 11059976 | | 3/1999 |
| JP | 2000-158843 | | 6/2000 |
| JP | 2000-272267 | | 10/2000 |
| JP | 2001122508 | | 5/2001 |
| JP | 2002104724 | | 4/2002 |
| JP | 2002211162 | | 7/2002 |

* cited by examiner

VERTICAL COLLATING MACHINE

TECHNICAL FIELD

The present invention relates to a vertical collating machine, and specifically a vertical collating machine having an imaging device for capture of images printed on respective sheets to be collated, and having a function checking collation errors based on image data acquired by the imaging device.

BACKGROUND ART

As a conventional collating machine in the prior art, there are a vertical collating machine carrying out sheet feeding from a plurality of sheet feeders which are arranged in a vertical direction and a horizontal collating machine carrying out sheet feeding from a plurality of sheet feeders which are arranged in a horizontal direction.

A conventional horizontal collating machine is occasionally a collating machine having respective sheet feeders provided with an imaging device for checking collation errors. In the horizontal collating machine, for each of the sheet feeders, images printed on sheets are photographed by the imaging device, the images captured are compared with reference images which were preliminarily recorded, and the presence of sheet feeding errors is determined based on the result of comparison.

JP 2000-158843 A discloses an example of this kind of horizontal collating machine. FIG. 7 illustrates a schematic constitution of the horizontal collating machine described in JP 2000-158843 A.

Referring to FIG. 7, the horizontal collating machine is provided with a plurality of sheet feeders A to F which are arranged in a horizontal direction, and glass windows (not illustrated) are arranged at the bottoms of sheet trays of the sheet feeders A to F. Light sources La to Lf and CCD cameras Ka to Kf are installed on the sheet trays through the glass windows. Thus, when lights from the light sources La to Lf are irradiated against the sheet stacks mounted on the sheet trays in the sheet feeders A to F, images which were printed in a predetermined area of the sheets are simultaneously photographed by the CCD cameras Ka to Kf.

The image data (not illustrated) acquired by the CCD) cameras Ka to Kf are inputted in an image processing device. In the image processing device, the image data are compared with reference image data stored beforehand, and sheet feeding errors (feeding operation of sheets with different printing, feeding operation of blank sheets, and the like) are checked. Then, when they are judged as correct sheets to be fed, the sheets Pa to Pf are discharged from the sheet feeders A to F. Then the sheets are conveyed on a feeding path T while the sheets are overlapped one another in order so as to be collated.

On the other hand, in a vertical collating machine, there exists also a need for realizing the check of collation errors by checking images printed on sheets to be collated, using imaging devices in like manner as the horizontal collating machine. Consequently, in a conventional technology, there exists a vertical collating machine which carries out the check of collation errors, by arranging illumination devices and CCD cameras nearby the sheet trays of respective sheet feeders and reading the images of sheets discharged from the sheet feeders.

However, since respective sheet feeders of a vertical collating machine are arranged in a vertical direction at the least possible space therebetween, there exists a little space nearby the sheet trays of the respective sheet feeders. Thus the provision of CCD cameras and the like in the space may cause a problem that they hinder charging new sheets to the sheet trays. In this case, in order to carry out the charging new sheets to the sheet trays as smoothly as possible, the illumination devices and CCD cameras are arranged at the discharge outlet side of sheets of the sheet feeders. In this constitution, however, when maintenance working such as the removal of stains in the illumination devices and CCD cameras is required, it is not easy to access these devices.

SUMMARY OF THE INVENTION

Accordingly, an object of the present invention is that in a vertical collating machine capable of photographing by imaging means the images of sheets discharged from respective sheet feeders and checking collation error based on the image data, a space for charging sheets to sheet feeders is adequately acquired and the maintenance of the illumination devices and CCD cameras can be easily performed.

In order to achieve the object, according to the present invention, there is provided a vertical collating machine comprising: a frame; a plurality of sheet feeding units attached to the frame and arranged in a vertical direction at spacing therebetween, the sheet feeding units feeding sheets from the respective sheet outlets one by one; a vertical sheet conveyance path provided on the frame and arranged oppositely with the sheet outlets of the sheet feeding units; conveyance means installed on the frame for sequentially receiving the sheets from the respective sheet feeding units and conveying the sheets vertically downward along the sheet conveyance path, and; control means controlling the sheet feeding units and the conveyance means in such a manner that the sheets fed from the sheet feeding units are conveyed while a sheet fed from the next lower sheet feeding unit is at least partially overlapped with a sheet fed from the upper sheet feeding unit, characterized in that at least one imaging means is arranged oppositely with the sheets conveyed on the sheet conveyance path, and the control means controls the motion of the imaging means and detects collation errors based on image data captured from the imaging means.

According to the preferable embodiment of the present invention, the imaging means comprises: a casing, the casing having end face arranged oppositely with the sheets conveyed; an aperture provided on the end face of the casing; light sources arranged on the end face of the casing for irradiating light toward the sheets conveyed; lens arrays arranged in the casing for receiving light reflected from the sheets conveyed and then injected from the aperture, and; light receiving element arrays arranged in the casing for receiving light emitted from the lens arrays.

According to the another preferable embodiment of the present invention, each of the sheet feeding units comprises: a sheet ejector for horizontally discharging the sheets one by one, and; a sheet feeding means arranged between the sheet ejector and the sheet conveyance path for receiving the sheets horizontally discharged from the sheet ejector and feeding the sheets from the sheet outlet to the sheet conveyance path while diverting their direction vertically downward.

According to the further preferable embodiment of the present invention, the sheet ejector comprises: a sheet tray on which a sheet stack is placed; a sheet delivery means arranged at the upper side of the sheet tray for sequentially feeding the sheet at the highest position of the sheet tray, and; a nozzle for blowing air so as to mutually separate the sheets at the upper portion of the sheet tray.

According to the further preferable embodiment of the present invention, the sheet feeding means comprises: a pair of a drive roller and an idle roller which are respectively arranged for rotation about horizontal rotational axes and contact with each other, whereby the sheets discharged from the sheet ejector are sequentially conveyed between the drive roller and the idle roller so as to be fed in the sheet conveyance path.

According to the further preferable embodiment of the present invention, the conveyance means comprises: a conveyer belt provided on the frame, the conveyance plane thereof being extended in a vertical direction along the sheet conveyance path, and; a conveyance roller arranged oppositely with the conveyance plane of the conveyer belt and brought in contact with the conveyance plane.

According to the further preferable embodiment of the present invention, the imaging means is arranged for each of the sheet feeding units and the imaging means is positioned at the downstream side of the sheet outlet of the associated sheet feeding unit in the sheet conveyance path.

According to the further preferable embodiment of the present invention, the control means performs the capture of the image data of the sheet at a predetermined area by the imaging means when the sheets fed from the sheet outlets of the sheet feeding units reach at the associated imaging means at the down-stream side of the sheet outlets.

According to the further preferable embodiment of the present invention, each of the sheet feeding units comprises a sensor arranged between the sheet ejector and the sheet feeding means for detecting the sheets transferred between the sheet ejector and the sheet feeding means, and the control means performs the capture of image data of the sheets at a predetermined area by the related imaging means, based on the detection signals from the sensor when the sensor detects the passage of the rear end of the sheet.

According to the further preferable embodiment of the present invention, each of the sheet feeding units comprises a sensor arranged between the sheet ejector and the sheet feeding means for detecting the sheets transferred between the sheet ejector and the sheet feeding means, and the control means performs the capture of image data of the sheets at a predetermined area by the associated imaging means, based on the detection signals from the sensor, after the lapse of a predetermined time from the detection of the ingression of the front end of the sheet by the sensor.

According to the further preferable embodiment of the present invention, the sheets fed from respective sheet feeding units are conveyed on the sheet conveyance path in as an aggregate in which the sheets are overlapped with one another so as to be sequentially offset from one another in a fore-to-aft direction, and a single imaging means is arranged at the down-stream side of the sheet outlet of the sheet feeding unit of the lowest site in the sheet conveyance path, and the control means performs the capture of image data at a predetermined area of the edge portion of respective sheets which compose the aggregate, by the imaging means at once, when the aggregate reaches at the imaging means.

DESCRIPTION OF THE PREFERED EMBODIMENTS

Figure 1:
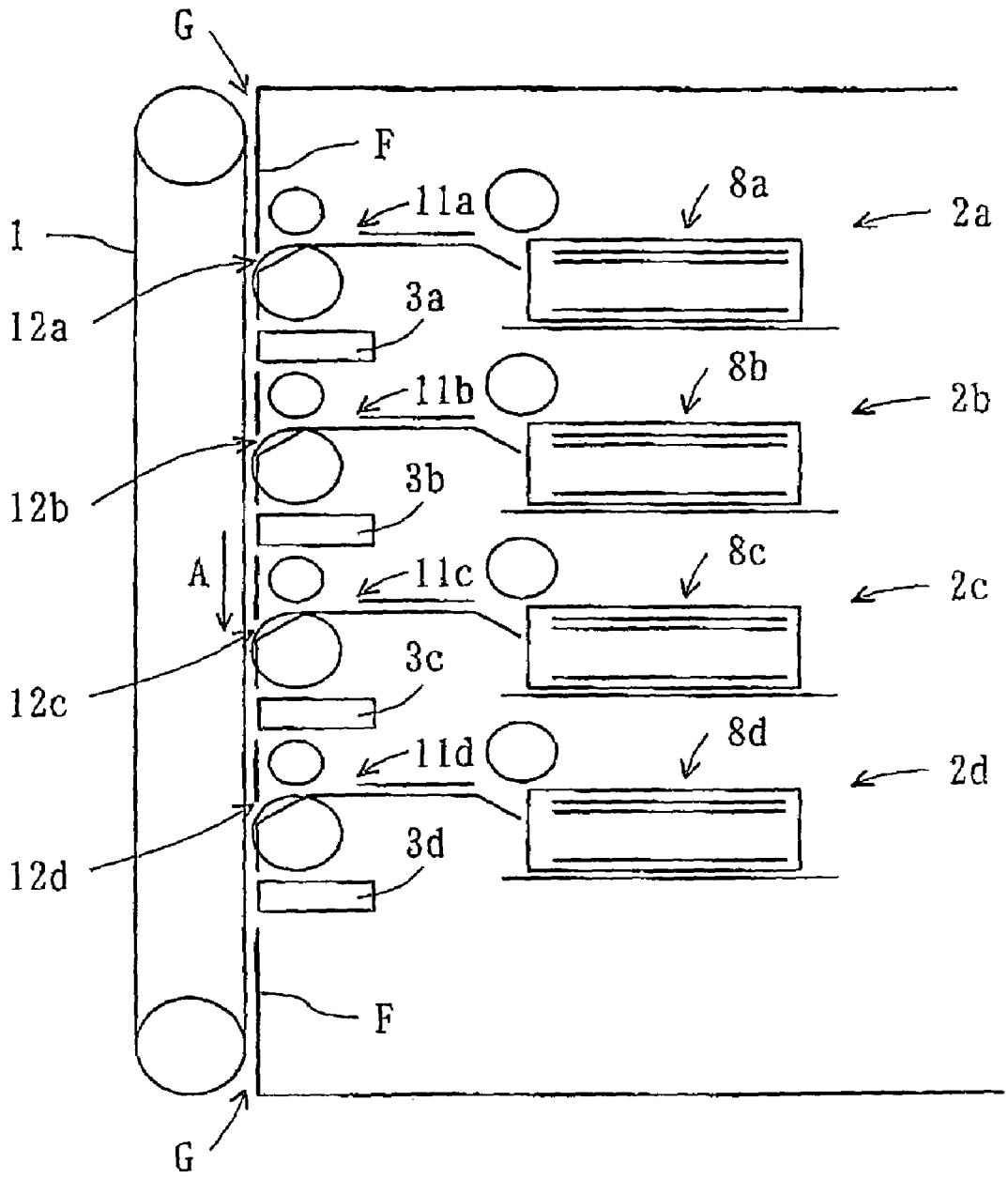
FIG. 1 is a side view schematically showing the constitution of the vertical collating machine according to one embodiment of the present invention.
Figure 2:
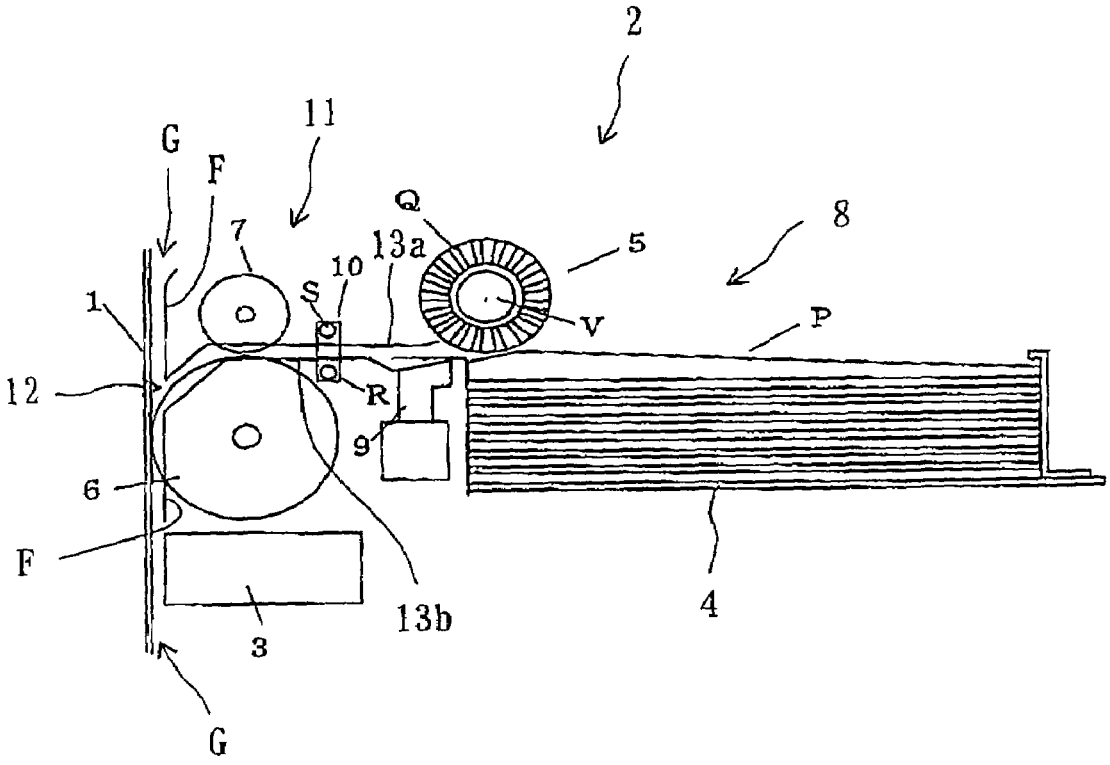
FIG. 2 is a side view schematically showing the constitution of the sheet feeding unit of the vertical collating machine shown in FIG. 1.

The preferred embodiments of the present invention are illustrated below referring the attached drawings. FIG. 1 is a side view schematically showing the constitution of the vertical collating machine according to one embodiment of the present invention. FIG. 2 is a side view schematically showing the constitution of the sheet feeding unit of the vertical collating machine shown in FIG. 1.

Referring to FIG. 1, the vertical collating machine of the present invention comprises a frame F and a plurality of sheet feeding units 2*a* to 2*d* attached to the frame F and arranged in a vertical direction at spacing therebetween. Each of the sheet feeding units 2*a* to 2*d* feeds the sheets one by one from the sheet outlets 12*a* to 12*d*. As shown in FIG. 2, the sheet feeding unit 2 comprises a sheet ejector 8 for horizontally discharging the sheets P one by one, and a sheet feeding means 11 arranged between the sheet ejector 8 and a sheet conveyance path G for receiving the sheets P horizontally discharged from the sheet ejector 8 and feeding the sheets P from the sheet outlet 12 to the sheet conveyance path G while diverting their direction vertically downward.

The sheet ejector 8 comprises a sheet tray 4 on which a sheet stack is placed, a sheet delivery means 5 arranged at the upper side of the sheet tray 4 for sequentially feeding the sheet P at the highest position of the sheet tray, and a nozzle 9 for blowing air so as to mutually separate the sheets P at the upper portion of the sheet tray 4. The sheet delivery means 5 comprises a horizontal vacuum rotor V extending in the width direction of the sheets P. The vacuum rotor V is provided with a lot of suction holes Q at the outer peripheral face and connected with a suction pump (not illustrated). Further, a pulley (not illustrated) is bound on the rotational axis of the vacuum rotor V, the pulley is linked with a belt drive mechanism, and the vacuum rotor V is driven by rotation thereby. Then, the vacuum rotor V adsorbs the sheet P by suction from the suction holes Q and feeds it in the tangent direction of the roller.

The sheet feeding means 11 comprises a pair of drive roller 6 and an idle roller 7 which are respectively arranged for rotation about horizontal rotational axes and contact with each other. Thus the sheets P discharged from the sheet ejector 8 are sequentially conveyed between a pair of the drive roller 6 and the idle roller 7 so as to be fed on the sheet conveyance path G.

The upper side and lower side guide plates 13*a* and 13*b* are arranged between the sheet ejector 8 and the sheet feeding means 11 for guiding both side rim portions of the sheet P.

A sensor 10 is arranged between the sheet ejector 8 and the sheet feeding means 11 for detection of the sheet P transferred. The sensor 10 comprises a pair of light emitting element S and light receiving element R. The sensor 10 is used for timing the capture of the image of sheet by the image means illustrated later. In embodiment, the sensor 10 is also used for detecting sheet feeding errors such as no sheet feeding and double sheet feeding by the sheet ejector 8.

The vertical collating machine further comprises the vertical sheet conveyance path G provided on the frame F and arranged oppositely with the sheet outlets 12*a* to 12*d* of the sheet feeding units 2*a* to 2*d*, and a conveyance means installed on the frame F for sequentially receiving sheets from respective sheet feeding units 2*a* to 2*d* and feeding the sheets vertically downward along the sheet conveyance path G. The conveyance means comprises a conveyer belt 1 whose conveying plane is extended in a vertical direction along the sheet conveyance path G. The drive roller 6 of the sheet feeding means 11 is arranged oppositely with the conveying plane of the conveyer belt 1 and brought in contact with the conveying plane, and functions also as a conveyance roller for conveying the sheets in cooperation with the conveyer belt 1. Thus the conveyer belt 1 can be easily separated from the residual portion of the collating machine at the boundary of the sheet conveyance path G, access can be easily carried out to the structural elements which face the conveyer belt 1 with respect to the sheet conveyance path G, for example, the imaging means 3*a* to 3*d* which are described later.

The sheets P discharged from the sheet outlets 12*a* to 12*d* of the sheet feeding units 2*a* to 2*d* are sequentially conveyed downward along the sheet conveyance path G by the respective pairs of the conveyer belt 1 and the drive roller 6.

The vertical collating machine of the present invention further comprises a control means which controls the motions of the sheet feeding units 2*a* to 2*d* and the conveyance means 1 and 6 in such a manner that the sheets P fed from the sheet feeding units 2*a* to 2*d* are conveyed while a sheet fed from the next lower sheet feeding unit is at least partially overlapped with a sheet fed from the upper sheet feeding unit. The details of the constitution of the control means are described later.

As shown in FIG. 1, according to the present invention, the imaging means 3*a* to 3*d* are arranged oppositely with the sheets conveyed on the sheet conveyance path G. The imaging means 3*a* to 3*d* are arranged for each of the sheet feeding units 2*a* to 2*d*, and respectively positioned at the downstream side of the sheet outlets 12*a* to 12*d* of the associated sheet feeding units 2*a* to 2*d* in the sheet conveyance path G.

Figure 3:
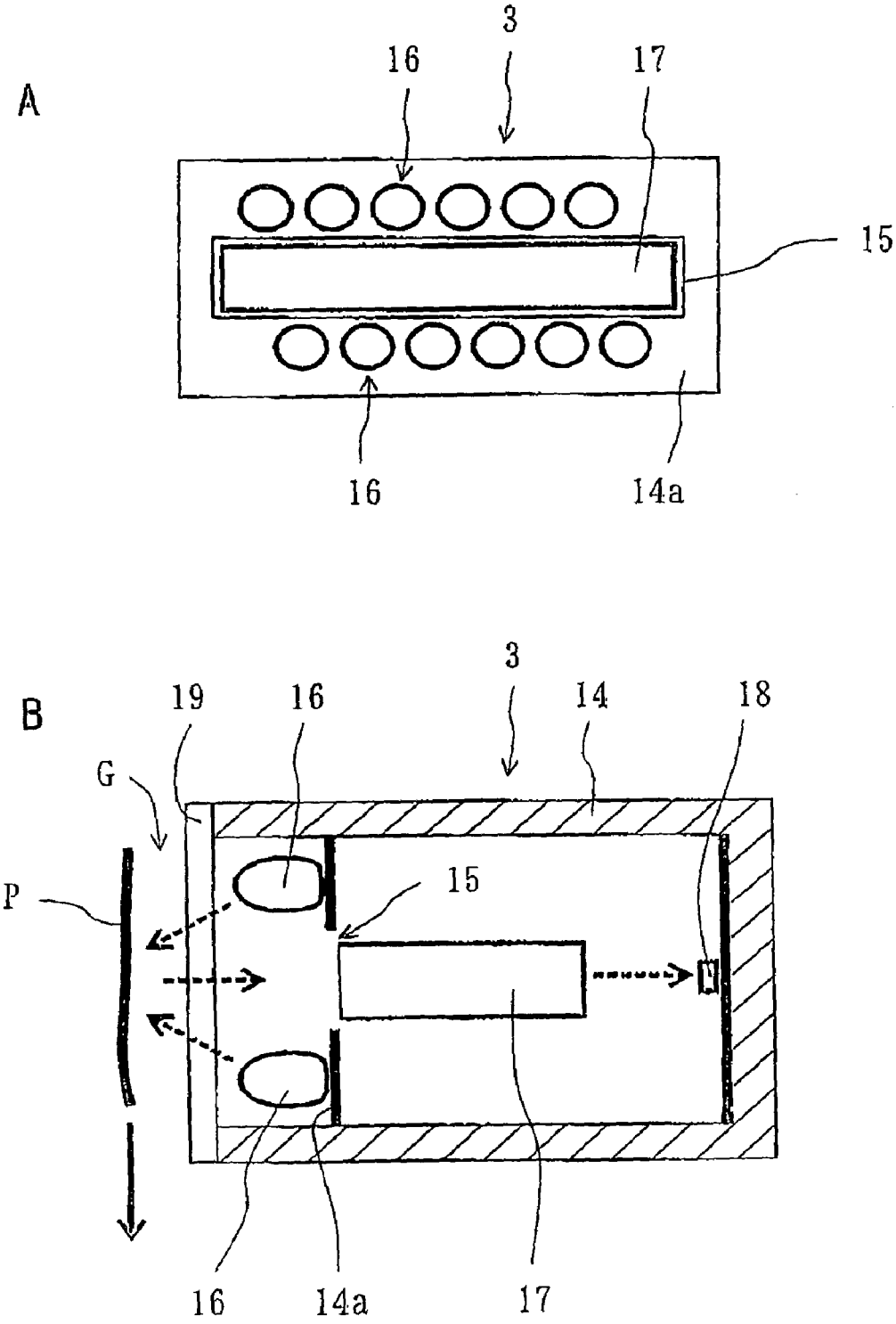
FIG. 3 is a view showing the constitution of an imaging means, (A) is a frontal view and (B) is a schematic sectional side view showing an internal structure.

FIG. 3 is a view showing the constitution of an imaging means, (A) is a frontal view and (B) is a schematic sectional side view showing an internal structure. Referring to FIG. 3, the imaging means 3 comprises a casing 14, and the casing 14 has end face 14*a* which are arranged oppositely with the sheets P conveyed. An aperture 15 is provided on the end face 14*a* of the casing 14 and is extended in the width direction of the sheets P conveyed. LED arrays 16 (light source) are arranged at the end face 14*a* of the casing 14 for irradiating light to the sheets P conveyed, and lens arrays 17 are arranged in the casing 14 for receiving light reflected from the sheets P conveyed and then injected from the aperture 15 and CCD arrays (light receiving element array) 18 are also arranged in the casing 14 for receiving light emitted from the lens arrays 17. A transparent glass 19 is installed on end face 14*a* of the casing 14 for protecting the LED arrays 16 and the lens arrays 17. Namely, the imaging means 3 have the mode of a line scanner and can capture images, for example, at a rate of 5000 times per second.

When the sheets P fed from the sheet outlets 12*a* to 12*d* of the sheet feeding units 2*a* to 2*d* reach at the imaging means 3*a* to 3*d* at the down-stream side of the associated sheet outlets 12*a* to 12*d*, the control means performs the capture of the image data of the sheet at a predetermined area by the imaging means 3*a* to 3*d*.

Figure 4:
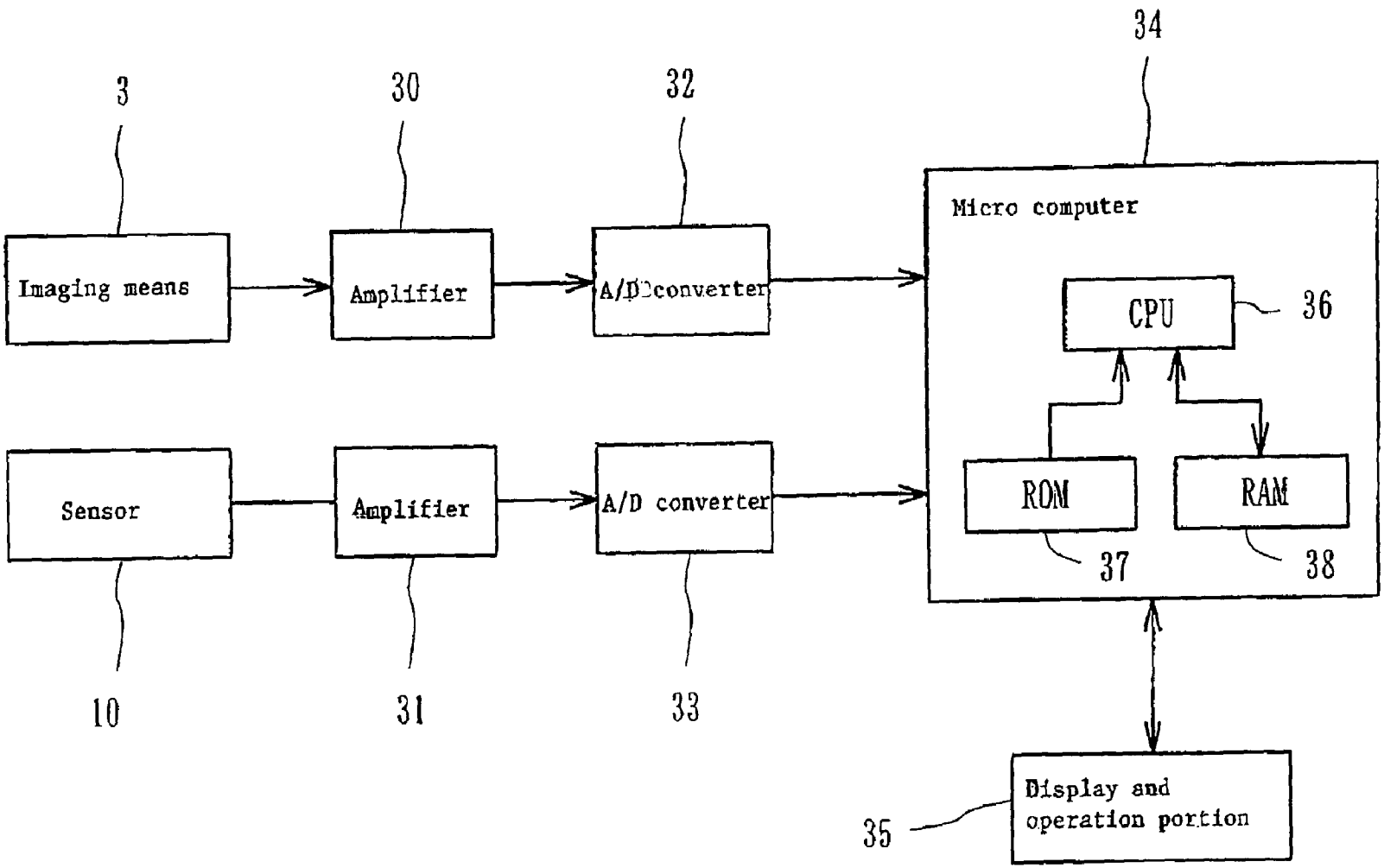
FIG. 4 is a block diagram showing the constitution of a portion which achieves a collation error detecting function in a control means.

FIG. 4 is a block diagram showing the constitution of a portion which achieves a collation error detecting function in the control means. Referring to FIG. 4, the control means comprises amplifiers 30 and 31 for amplifying the outputs of the imaging means 3 and the sensor 10, A/D converters 32 and 33 for carrying out A/D conversion of the outputs of the amplifiers 30 and 31, a micro computer 34 to which the output of the A/D converters 32 and 33 is inputted, and a display and operation portion 16 connected with the micro computer 34. In this case, either of the amplifiers 30 and 31 and the A/D converters 32 and 33 is individually provided at either of the imaging means 3*a* to 3*d* of the sheet feeding units 2*a* to 2*d* and the sensor 10, but in FIG. 4, they are integrally represented by a single block.

The micro computer 34 comprises CPU 36, ROM 37 and RAM 38. CPU 36 performs a program stored in ROM 37, performs various programs necessary for motion of the vertical collating machine which are stored in RAM 18, and controls the motions of respective constitutional portions of the vertical collating machine. RAM 18 further comprises SRAM and the like, stores temporary data generated at performance of the program, and stores image data captured from the imaging means 3.

Figure 5:
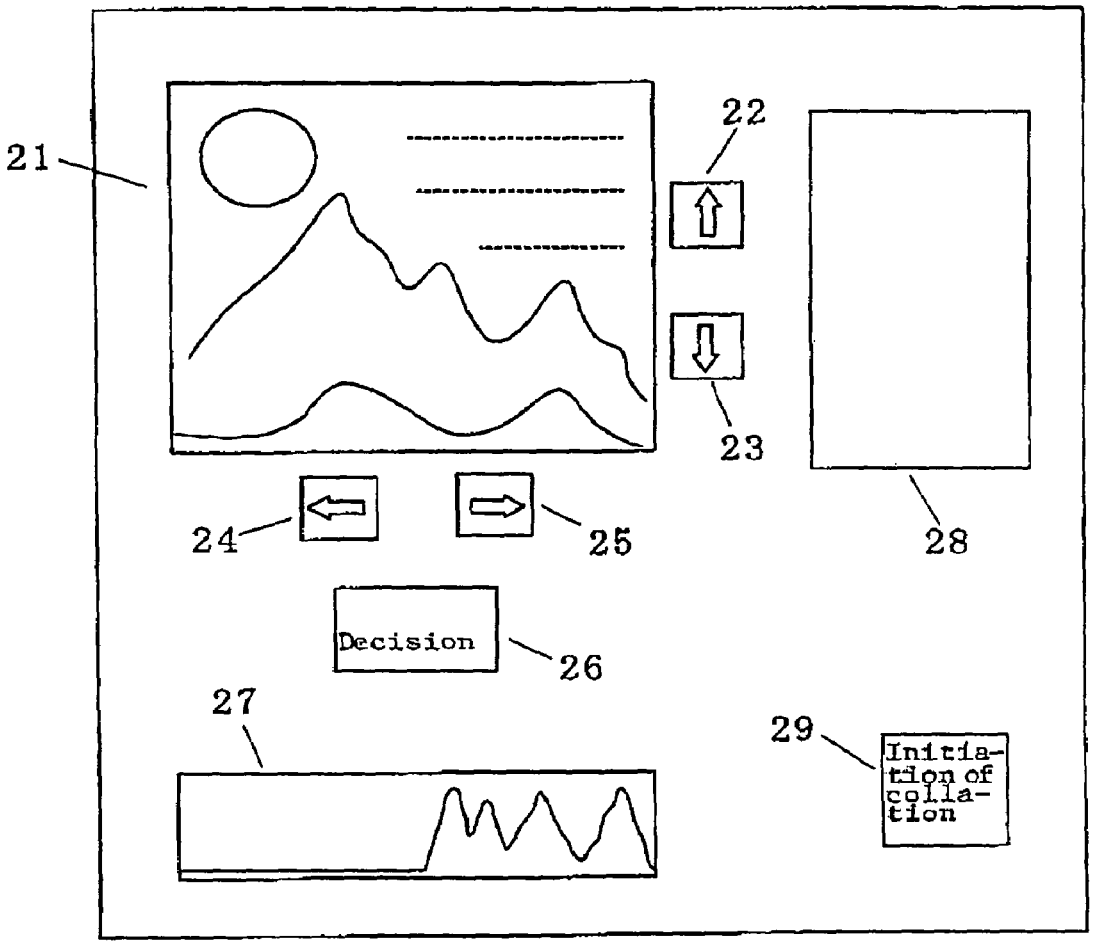
FIG. 5 is a plan view showing the display and operation panels of the vertical collating machine of the present invention.

The display and operation portion 35 has a display and operation panel shown in FIG. 5 and is provided with a display portion 21 for displaying image data captured, the values of various control parameters and the like, scroll buttons 22 to 25 for scrolling images which are displayed on the display portion 21, to up and down and left and right directions, a decision button 26 which decides images being the basis of collation error detection, a signal display portion 27 which sequentially displays signals outputted from the imaging means 3, a functional operation portion 28 and a collation initiation button 29.

Figure 6:
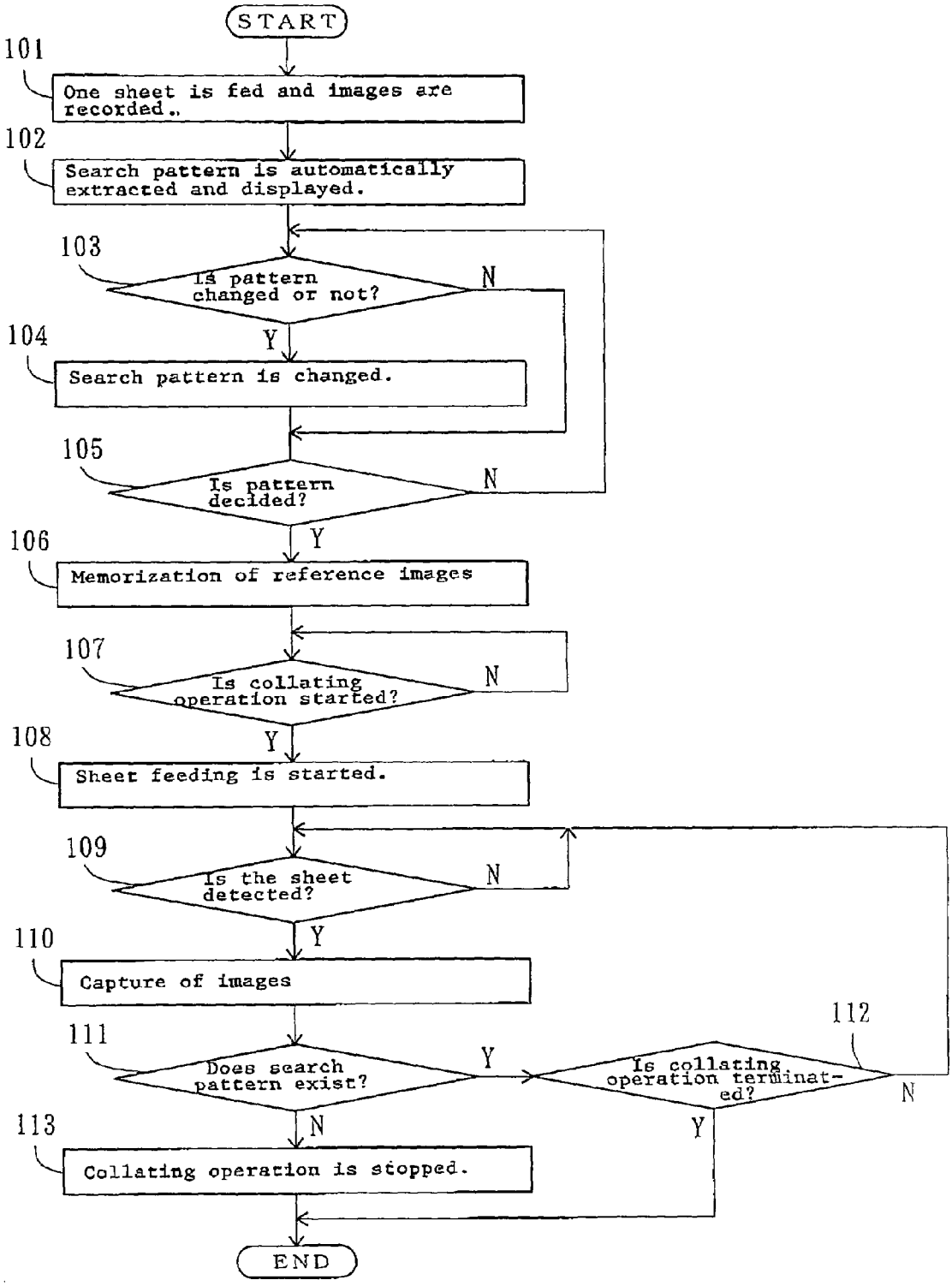
FIG. 6 is a flow chart showing the collation error detecting motion of the vertical collating machine.
Figure 7:
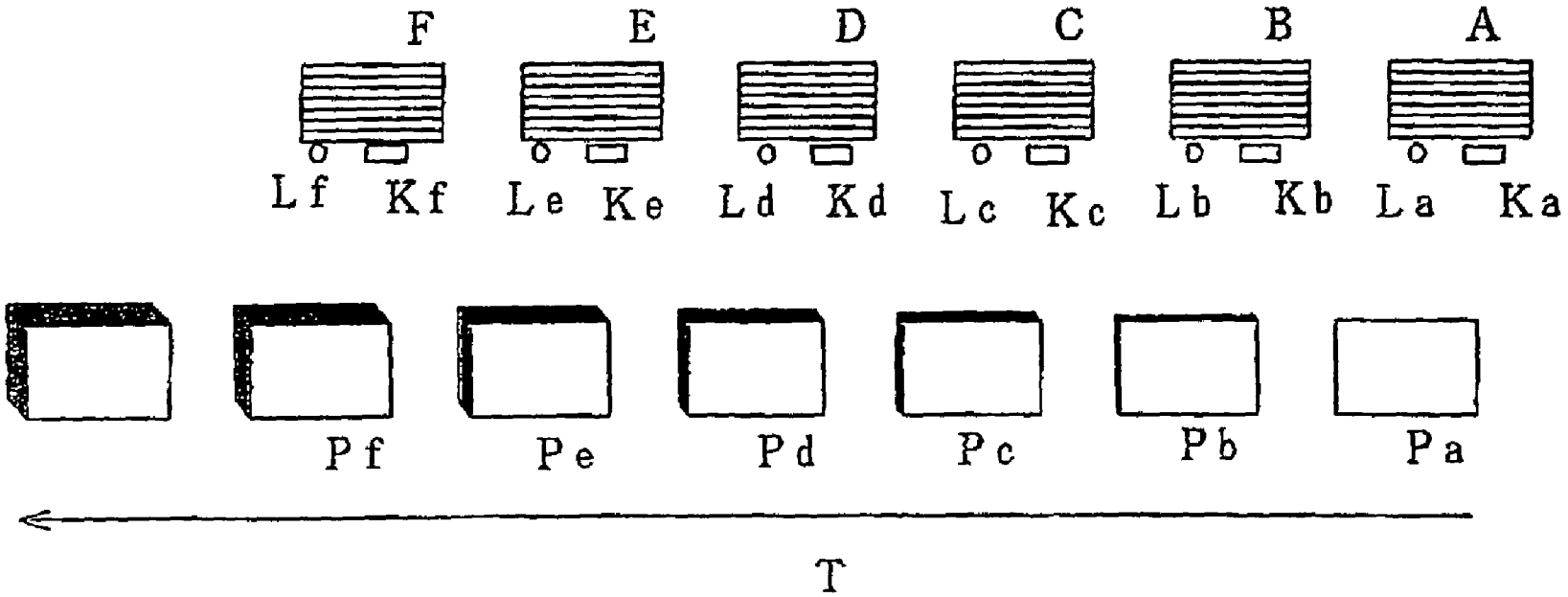
FIG. 7 is a view schematically showing the constitution of a conventional horizontal collating machine in which imaging devices are provided on respective sheet feeders.

FIG. 6 is a flow chart showing the collation error detecting motion of the vertical collating machine. Referring to FIG. 6, when the initiation signals of collation error detection motion is emitted through the functional operation portion 28 of the display and operation panel, CPU 36 feeds one sheet on the sheet conveyance path G from the sheet feeding unit 2*a* at the highest position and conveys it by the conveyance means. At this time, CPU 36 firstly detects the ingression of the front end of the sheet P discharged from the ejector 8*a* to the detection zone of the sensor 10 based on the detection signals of the sensor 10 which is inputted through the amplifier 30 and the A/D converter 32. Simultaneously, it determines also whether sheet feeding errors to the sheet feeding means 11*a* occur or not. When normal sheet feeding is carried out, CPU 36 performs the capture of image data of a predetermined area of the sheet P by the imaging means 3 after the lapse of a predetermined time from detection of the ingression of the front end of the sheet P by the sensor 10. Then the image data captured from the imaging means 3*a* are inputted in RAM 38 as the image data of a reference sheet through the amplifier 31 and the A/D converter 33 and stored (the step 101 of FIG. 6). At this time, CPU 36 displays signals outputted from the imaging means 3*a*, on the signal display portion 27.

When the capture of the image data of the basis sheet is completed, CPU 36 extracts as a search pattern a portion which represents most effectively the characteristic of the basis sheet among images captured, for example, a portion in which the change of color data of pixels composing the images is great and displays it on the display portion 21 (the step 102 of FIG. 6). Then, CPU 36 determines whether the change of a search pattern is indicated or not, by determining whether the scroll buttons 22 to 25 are pushed or not (the step 103 of FIG. 6). Further, when the change of a search pattern is indicated, the images which are represented by the display portion 21 are scrolled in correspondence with the operation of the scroll buttons 22 to 25, the search pattern is changed (the step 104 of FIG. 6).

Then, CPU 36 determines whether the search pattern is decided or not, by determining whether the decision button 26 is pushed or not (the step 105 of FIG. 6). When decision is not carried out, it returns to the step 103. When CPU 36 determines that the search pattern is decided, CPU 36 sets the decided search pattern as the reference images and stores the image data in RAM 38 (the step 106 of FIG. 6).

The above-mentioned steps 101 to 106 are also sequentially performed for the sheet feeding units 2*b* to 2*d* in like manner as the sheet feeding unit 2*a*, and respective reference images are stored in RAM 38.

When the search pattern is decided, CPU 38 determines whether collating operation is started or not by determining whether the collation initiation button 29 is pushed or not (the step 107 of FIG. 6). When the collation initiation button 29 is pushed, sheet feeding from the sheet feeding units 2*a* to 2*d* is started (the step 108 of FIG. 6). During the sheet feeding is carried out, CPU 38 detects that the front ends of the sheets P which are discharged from the ejectors 8*a* to 8*d* proceed at the detection zone of the sensor 10 based on the detection signals from the sensor 10 of the respective sheet feeding units 2*a* to 2*d*. Simultaneously, it determines whether sheet feeding errors to the sheet feeding means 11*a* to 11*d* occur or not (the step 109 of FIG. 6). When normal sheet feeding is carried out from the sheet feeding units 2*a* to 2*d*, CPU 36 performs the capture of image data of the sheets P at a predetermined area by the related imaging means 3*a* to 3*d* after the lapse of a predetermined time from detection of the ingression of the front ends of the sheets P, by every sheet feeding units 2*a* to 2*d* (the step 110 of FIG. 6). Further, CPU 36 stores in RAM 38 the image data captured, determines whether the search pattern is contained in the sheets conveyed or not, by comparing the image data with the data of reference images which are preliminarily stored in RAM 38 (the step 111 of FIG. 6), and detects whether the sheets in which printing content differs and a white sheet without printing are mixed or not. When the search pattern is contained in the sheets conveyed, CPU 36 determines whether the collating operation is completed or not (the step 112 of FIG. 6). When the collating operation is not completed, CPU 36 returns to the step 109 and when the collating operation is completed, the program is terminated.

When the search pattern is determined to not be contained in the sheets conveyed in the step 111, CPU 36 determines that the collation errors are generated, stops the collating operation, displays the occurrence of the collation errors on the display portion 21 and stops the collating operation temporarily (the step 113 of FIG. 6). Further, the collating operation is performed at a high speed and the collating operation is performed even after the time at which the collation errors are detected; therefore if it is represented on the display portion 21 after termination of the collating operation that the collation errors are derived from the sheet which is fed from what steps of the sheet feeding units among collated objects, the sheet related can be easily removed from the collated objects.

Thus, according to the present invention, since the imaging means are arranged on the sheet conveyance path, a space enough for the sheet charging can be acquired nearby the sheet trays of respective sheet feeding units. In addition, by forming the sheet conveyance path as the boundary between the conveyer belt and the residual portion of the collating machine, easy access to respective imaging means is achieved and easy maintenance of the LED arrays and CCD arrays of the imaging devices is achieved.

In this case, when the stains of the imaging means are automatically detected and can be informed to a user, it is very convenient. In order to realize this, when the sheet does not exist the detection zone of the imaging means, it is designed so that a predetermined pattern is always captured by the imaging means, and when the sheet does not exist, CPU 36 is designed to judge that when the pattern cannot be clearly photographed, stains and troubles are generated in the imaging means, and displays it on the display portion 21.

Although the preferable embodiment of the present invention is illustrated above, the constitution of the present invention is not limited to the embodiment. For example, in the above-mentioned embodiment, the control means is designed to perform the capture of image data of the sheets by the imaging means after the lapse of a predetermined time from detection of the ingression of the front ends of the sheets by the sensor, but the imaging means may be designed to perform the capture of image data of the sheets by the imaging means when the sensor detects the passage of back end of the sheets. Alternatively, the imaging means may be designed to perform the capture of image data of the sheets at a predetermined area by the imaging means when the sheets fed from the sheet outlet of the sheet feeding units reach at the position of the imaging means which are related to the down-stream side of the sheet outlet.

Thus, the image data of the sheets can be captured at the optimum timing in accordance with the thickness of sheets to be collated and the degree of overlapping at conveyance of respective sheets, by changing the timing of the capture of images by the imaging means, and the detection accuracy of collation errors can be improved.

According to another embodiment which is not illustrated, sheets fed from respective sheet feeding units are conveyed on the sheet conveyance path in as an aggregate in which the sheets are overlapped with one another so as to be sequentially offset from one another in a fore-to-aft direction, and a single imaging means is arranged at the down-stream side of the sheet outlet of the sheet feeding unit of the lowest site in the sheet conveyance path, and the control means performs the capture of image data at a predetermined area (figures, bar codes and the like which can judge respective sheets are printed) of the edge portion of respective sheets which compose the aggregate, by the imaging means at once, when the aggregate reaches at the imaging means. Since this embodiment arranges only a single imaging means and can carry the detection of collation errors, it is very advantageous from the viewpoint of cost.

The invention claimed is:

1. A vertical collating machine comprising:

a frame;

a plurality of sheet feeding units attached to the frame and arranged in a vertical direction at spacing therebetween, the sheet feeding units being operative for feeding sheets from respective sheet outlets one by one;

a vertical sheet conveyance path provided on the frame and arranged oppositely with the sheet outlets of the sheet feeding units;

conveyance means installed on the frame for sequentially receiving the sheets from the respective sheet feeding units and conveying the sheets vertically downward along the sheet conveyance path;

each of the sheet feeding units having a sheet ejector for horizontally discharging the sheets one by one, and a sheet feeding means arranged between the sheet ejector and the sheet conveyance path for changing the direction of the sheets horizontally discharged from the sheet ejector so as to feed the sheets vertically downward from the sheet outlet to the sheet conveyance path;

the sheet feeding means comprising a pair of a drive roller and an idle roller which are respectively arranged for rotation about horizontal rotation axes and contact with each other, whereby the sheets discharged from the sheet ejector are sequentially conveyed between the drive roller and the idle roller so as to be fed in the sheet conveyance path;

the conveyance means comprising a conveyer belt provided on the frame and having a conveyance plane extending in a vertical direction along the sheet conveyance path, and a conveyance roller arranged oppositely with the conveyance plane of the conveyer belt and brought in contact with the conveyance plane;

control means for controlling the sheet feeding units and the conveyance means in such a manner that the sheets fed from the sheet feeding units are conveyed while a sheet fed from a next lower sheet feeding unit is at least partially overlapped with a sheet fed from an upper sheet feeding unit;

each of the sheet feeding units having an imaging means positioned at a downstream side of the sheet outlet of the sheet feeding unit and arranged oppositely with the sheets conveyed on the sheet conveyance path; and the control means comprising a display and operation portion having a display portion for displaying image data of images captured by the imaging means, scroll buttons for scrolling the images displayed on the display portion, and a decision button for determining a search pattern in the images displayed on the display portion for each of the sheet feeding units, the search pattern consisting of an image portion in which color data of pixels comprising the images is significantly changed, and a random access memory (RAM) for storing image data of the search patterns, the control means being operative for detecting collation errors during collation operation by comparing the image data captured by the imaging means with the image data of the search pattern stored in the RAM for each of the sheet feeding units so as to determine whether or not the search pattern is contained in a respective sheet.

2. The vertical collating machine according to claim 1, characterized in that the imaging means comprises:

a casing having an end face arranged oppositely with the sheets conveyed;

an aperture provided on the end face of the casing;

light sources arranged on the end face of the casing for irradiating light toward the sheets conveyed;

lens arrays arranged in the casing for receiving light reflected from the sheets conveyed and then injected from the aperture; and light receiving element arrays arranged in the casing for receiving light emitted from the lens arrays.

3. The vertical collating machine according to claim 1, characterized in that the sheet ejector comprises:

a sheet tray on which a sheet stack is placed;

a sheet delivery means arranged at an upper side of the sheet tray for sequentially feeding the sheet at a highest position of the sheet tray; and a nozzle for blowing air so as to mutually separate the sheets at an upper portion of the sheet tray.

4. The vertical collating machine according to claim 1, characterized in that the control means performs the capture of the image data of the sheet at a predetermined area by the imaging means when the sheets fed from the sheet outlets of the sheet feeding units reach at the associated imaging means at the downstream side of the sheet outlets.

5. The vertical collating machine according to claim 1, characterized in that each of the sheet feeding units comprises a sensor arranged between the sheet ejector and the sheet feeding means for detecting the sheets transferred between the sheet ejector and the sheet feeding means, and the control means performs the capture of the image data of the sheets at a predetermined area by the related imaging means, based on detection signals from the sensor when the sensor detects passage of a rear end of the sheet.

6. The vertical collating machine according to claim 1, characterized in that each of the sheet feeding units comprises a sensor arranged between the sheet ejector and the sheet feeding means for detecting the sheets transferred between the sheet ejector and the sheet feeding means, and the control means performs the capture of the image data of the sheets at a predetermined area by the associated imaging means, based on detection signals from the sensor, after lapse of a predetermined time from detection of ingression of a front end of the sheet by the sensor.

* * * * *